US006824402B2

(12) United States Patent
Kuo et al.

(10) Patent No.: US 6,824,402 B2
(45) Date of Patent: Nov. 30, 2004

(54) GROUNDING MEANS USED IN A CABLE ASSEMBLY

(75) Inventors: Chin Pao Kuo, Tu-chen (TW); Shih Tung Chang, Tu-chen (TW); Yun Long Ko, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/328,548

(22) Filed: Dec. 23, 2002

(65) Prior Publication Data

US 2004/0115974 A1 Jun. 17, 2004

(30) Foreign Application Priority Data

Dec. 17, 2002 (CN) ..... 91220450 U

(51) Int. Cl.[7] ..... H01R 4/66; H01R 13/648

(52) U.S. Cl. ..... 439/92; 439/98; 174/74 R

(58) Field of Search ..... 439/99, 92, 98, 439/495–497; 174/74 R, 78

(56) References Cited

U.S. PATENT DOCUMENTS 3,337,834 A * 8/1967 Godwin et al. ..... 439/497
4,619,487 A * 10/1986 Brush, Jr. ..... 439/98
5,315,063 A * 5/1994 Auclair ..... 174/78
5,473,117 A * 12/1995 Morgan et al. ..... 174/78
6,010,359 A * 1/2000 Etters et al. ..... 439/496
6,482,027 B2 * 11/2002 Ishii et al. ..... 439/495
6,595,789 B2 * 7/2003 Oota et al. ..... 439/98

* cited by examiner

*Primary Examiner*—Hae Moon Hyeon
(74) *Attorney, Agent, or Firm*—Wei Te Chung

(57) ABSTRACT

A grounding means (1) used in a cable assembly (100) includes a metallic shell (2), a conductive fabric tape (3) attached onto the metallic shell, and a lock member (4) encased in the metallic shell for securing the conductive fabric tape with the shell. The metallic shell defines a receiving space (24) receiving the lock member and has an inner surface (201) and an opposite outer surface (202). The conductive fabric tape covers the inner and outer surfaces of the metallic shell and extends beyond a forward end (23) of the metallic shell a predetermined length L. The lock member has a pair of ears (42) formed on opposite lateral sides thereof for engaging with corresponding cutouts (220) of the metallic shell. A number of embossments (46) are formed on the lock member for abutting against the fabric tape.

13 Claims, 8 Drawing Sheets

GROUNDING MEANS USED IN A CABLE ASSEMBLY

BACKGROUND OF THE INVENTION

1. Field of the Invention

The present invention generally relates to a grounding means, and particularly to a grounding means of a cable assembly used in a notebook computer.

2. Description of Prior Arts

A computer system, such as a personal computer or notebook computer, emits EMI radiation and other electronic "noise" due to the electronic components included in the computer system. Various threshold values defining acceptable levels of EMI radiation from a computer system have been established, for example, by government agencies. To be EMI-compliant in accordance with these established EMI radiation limits, computer manufacturers have taken steps to minimize EMI radiation levels emitted from various components of computer systems and also to minimize EMI radiation levels emitted from wires and cables used to interconnect various components, such as to connect a display device to the motherboard. Various techniques are employed to reduce EMI emissions from not only the electronic components but also the cables. For example, a special metallic casing may be used over a liquid crystal display (LCD) device, or a special metallic paint may be used on the inside of computer casings, or a special ground line may be used in a cable assembly. As shown in FIG. 7, a cable assembly 9 adapted for interconnecting a display device to a motherboard of a notebook computer is illustrated. The cable assembly 9 includes a cable end connector 91, a number of wires 92 attached to the cable end connector 91, and a conductive cloth 93 surrounding the wires 92. The number of wires 92 comprise a number of signal wires and ground wires. However, the ground wires do not conductively contact with the conductive cloth 93 such that the conductive cloth 93 is not actually grounded.

In FIG. 8, another cable assembly 8 is disclosed. The cable assembly 8 further employs a ground ring 81 connecting with a ground line 82 and subsequently connecting with a ground means included in a notebook computer to thereby more effectively eliminate EMI occurred in the notebook computer. Conventionally the ground line 82 together with the ground ring 81 conductively engages with the ground means via a screw means. However, it is very possible that the screw means mechanically loosens up and then the ground ring 81 disengages from the ground means, which will adversely influences the EMI elimination. Further, and of more significance, there is little free space in now developed, lower profile notebook computer or thinner laptop computers due to the density of the overall packaging of the computer system components. Obviously, the ground ring 81 shown in FIG. 8 which should be engaged with the ground line through a screw means, occupies a large amount of space and avoidably increases the whole height of the notebook computer.

Hence, an improved grounding means of a cable assembly used in a notebook computer is highly desired to overcome the above-mentioned defects of current art.

BRIEF SUMMARY OF THE INVENTION

Accordingly, an object of the present invention is to provide a grounding means used in a cable assembly which can achieve an effective grounding against EMI.

Another object of the present invention is to provide a grounding means used in a cable assembly which has a reduced height.

Still another object of the present invention is to provide a grounding means used in a cable assembly which can achieve a reliable grounding path.

Still another object of the present invention is to provide a grounding means used in a cable assembly which can be easily manufactured and assembled.

In order to achieve the above-mentioned objects, a grounding means in accordance with the present invention, which is used in a cable assembly, includes a metallic shell, a conductive fabric tape attached onto the metallic shell, and a lock member encased in the metallic shell for securing the conductive fabric tape with the shell. The metallic shell defines a receiving space receiving the lock member and has an inner surface and an opposite outer surface. The conductive fabric tape covers the inner and outer surfaces of the metallic shell, and extends beyond a forward end of the metallic shell a predetermined length L. The lock member has a pair of ears formed on opposite lateral sides thereof for engaging with corresponding cutouts of the metallic shell. A number of embossments are formed on the lock member for abutting against the fabric tape.

Other objects, advantages and novel features of the invention will more apparent from the following detailed description of the present embodiment when taken in conjunction with the accompanying drawings.

DETAILED DESCRIPTION OF THE INVENTION

Figure 1:
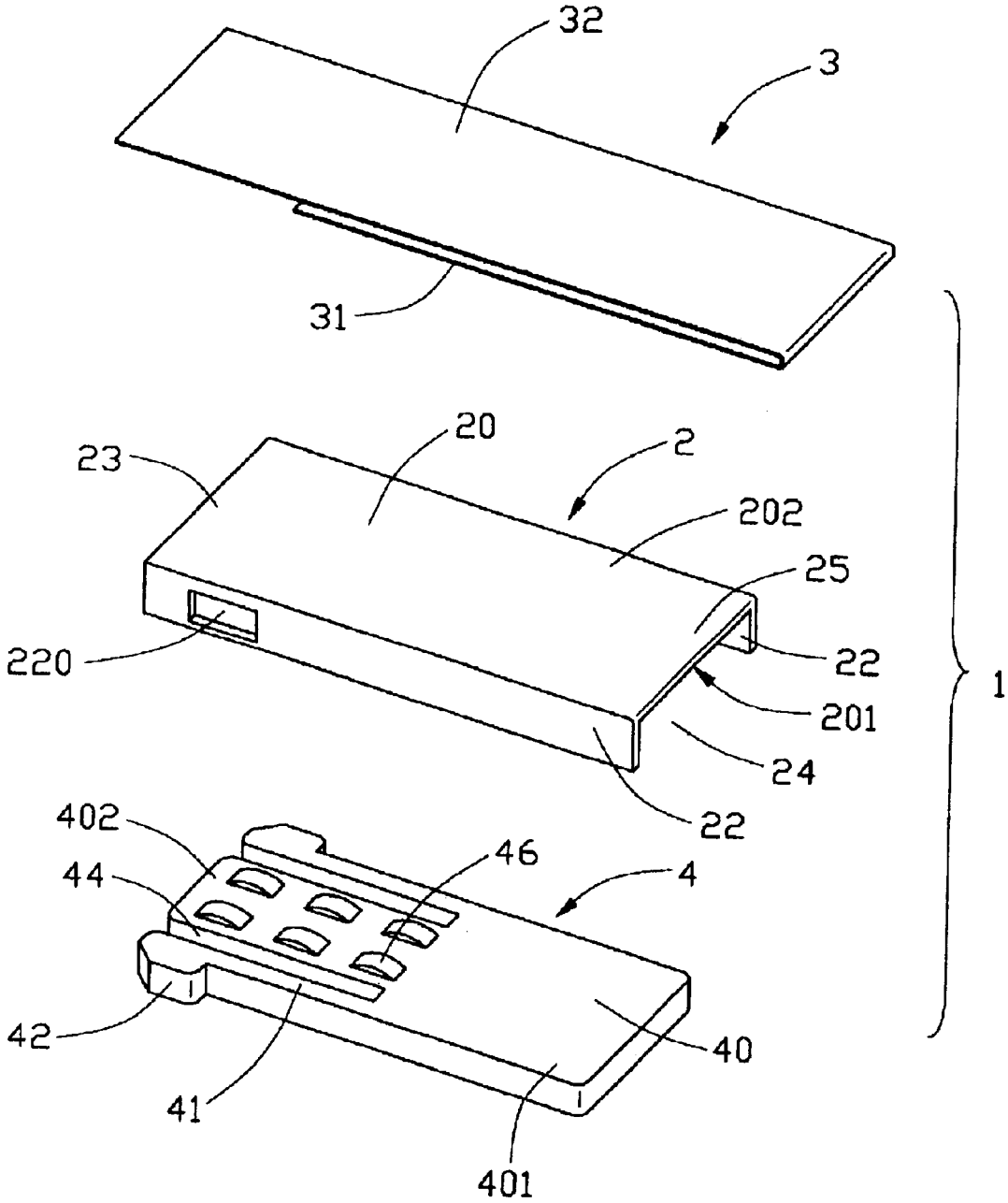
FIG. 1 is an exploded, perspective view of a grounding means in accordance with the present invention.
Figure 2:
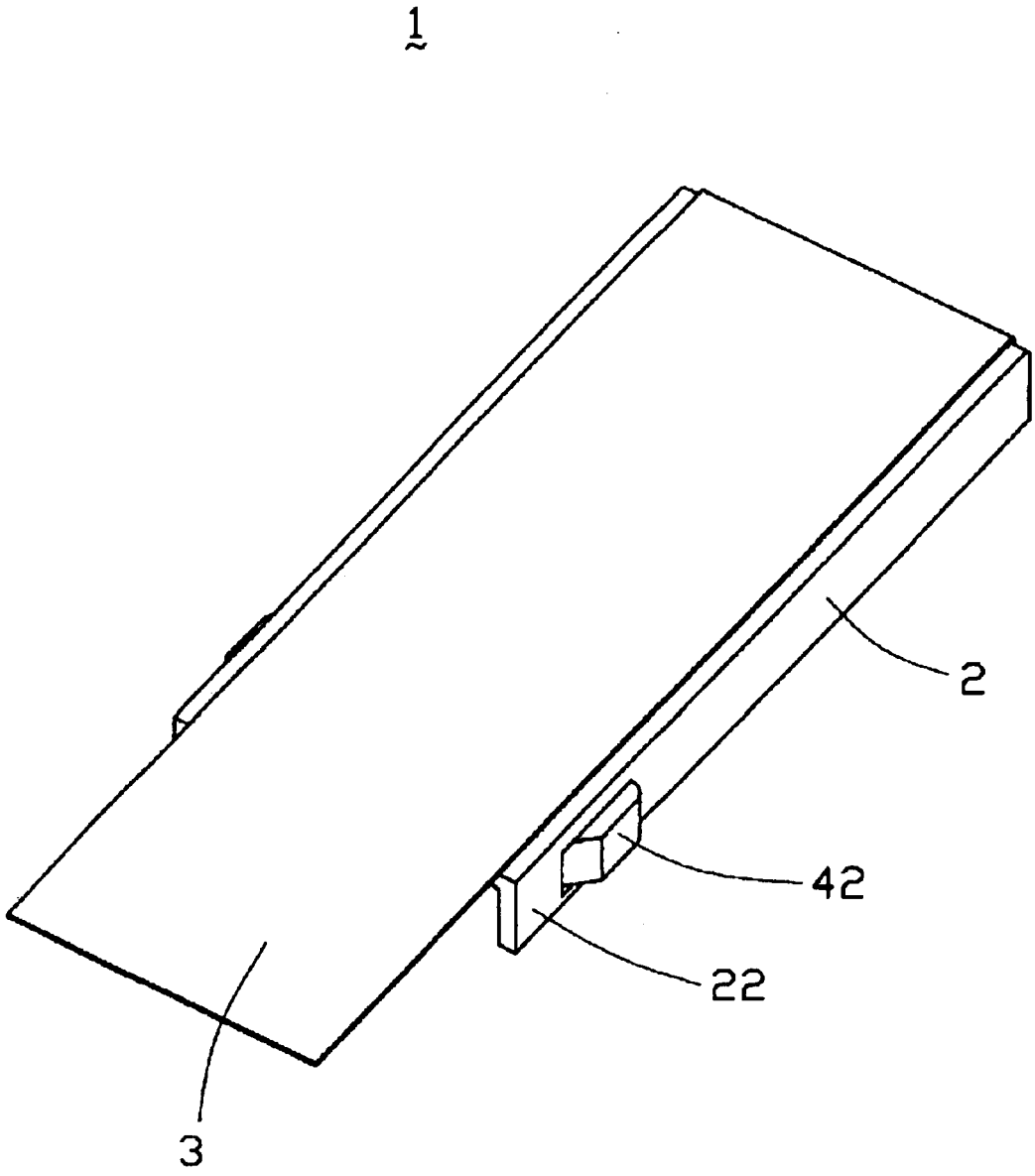
FIG. 2 is an assembled view of FIG. 1.

Reference will now be made to the drawing figures to describe the present invention in detail.

Together referring to FIGS. 1–4, a grounding means 1 in accordance with the present invention, which is adapted for using in a cable assembly 100 (FIG. 6) for interconnecting a LCD device (not shown) and a base portion of a notebook computer (not shown), includes a metallic shell 2, a conductive fabric tape 3, and a lock member 4.

The metallic shell 2 is stamped and configured from a metal sheet. A pair of side walls 22 extend oppositely from two lateral edges of a main portion 20 of the metallic shell 2. Each side wall 22 defines a rectangular cutout 220 thereon adjacent to a forward end 23 of the metallic shell 2. The main portion 20 has an inner surface 201 and an opposite outer surface 202. A receiving space 24 is defined between the two side walls 22 and the main portion 20 for receiving the lock member 4, which will be described in great detail hereinafter.

Figure 3:
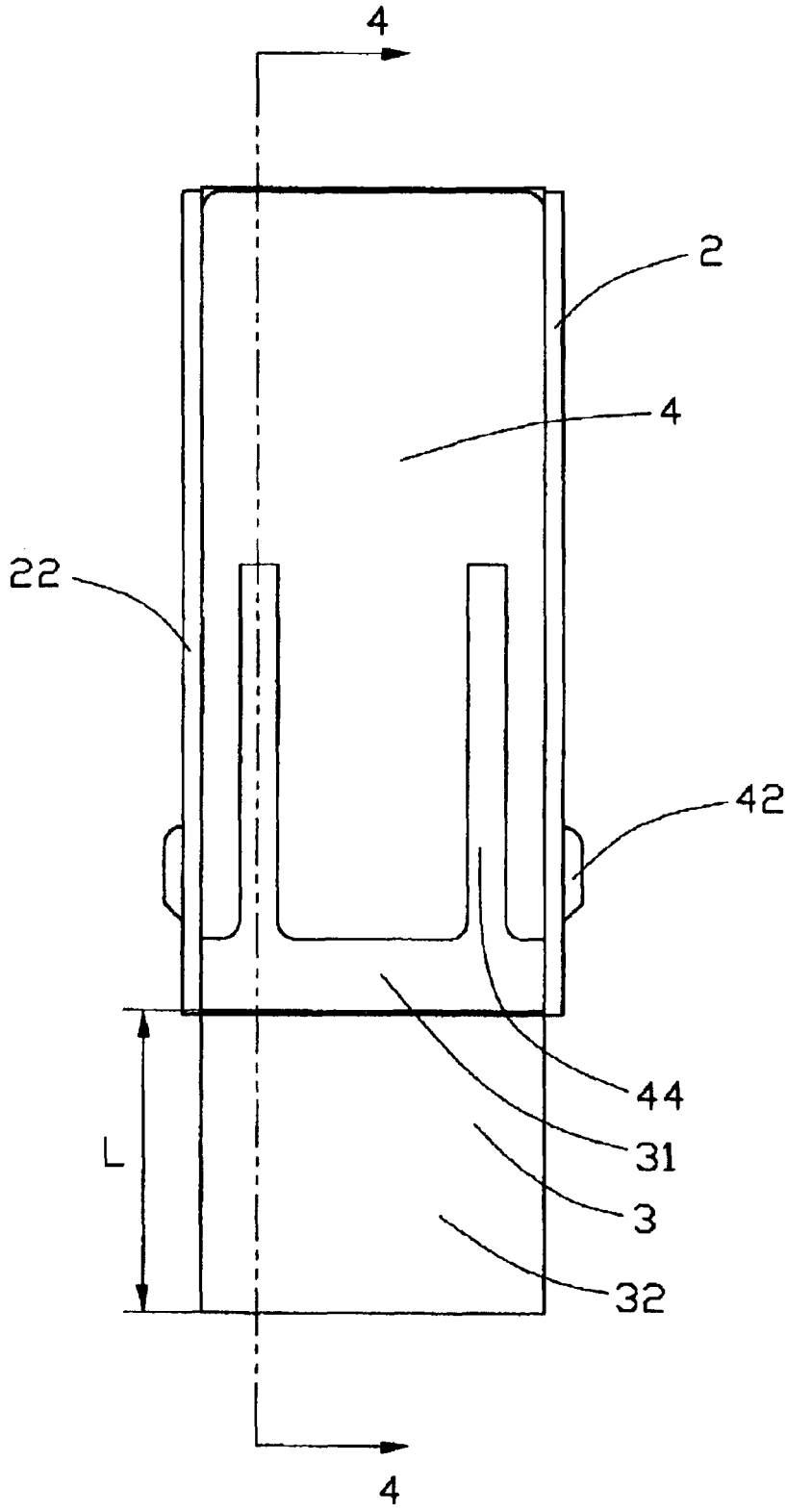
FIG. 3 is a bottom planar view of FIG. 2.
Figure 4:
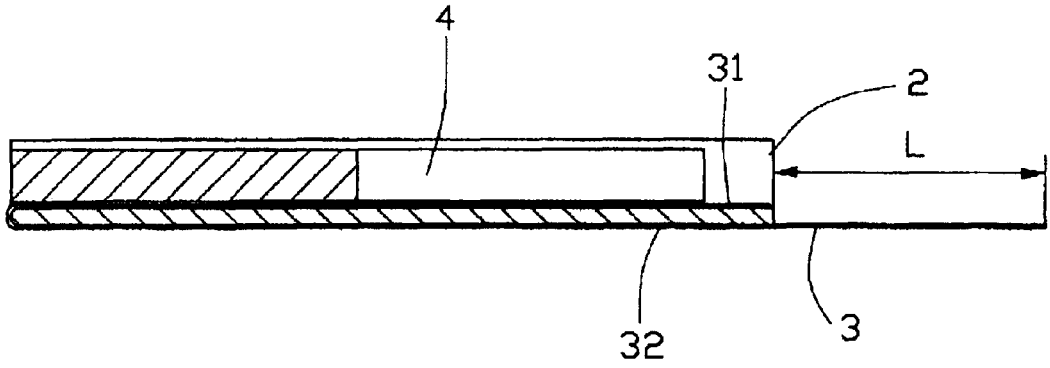
FIG. 4 is a cross-section view of FIG. 3 taken along line 4—4.
Figure 5:
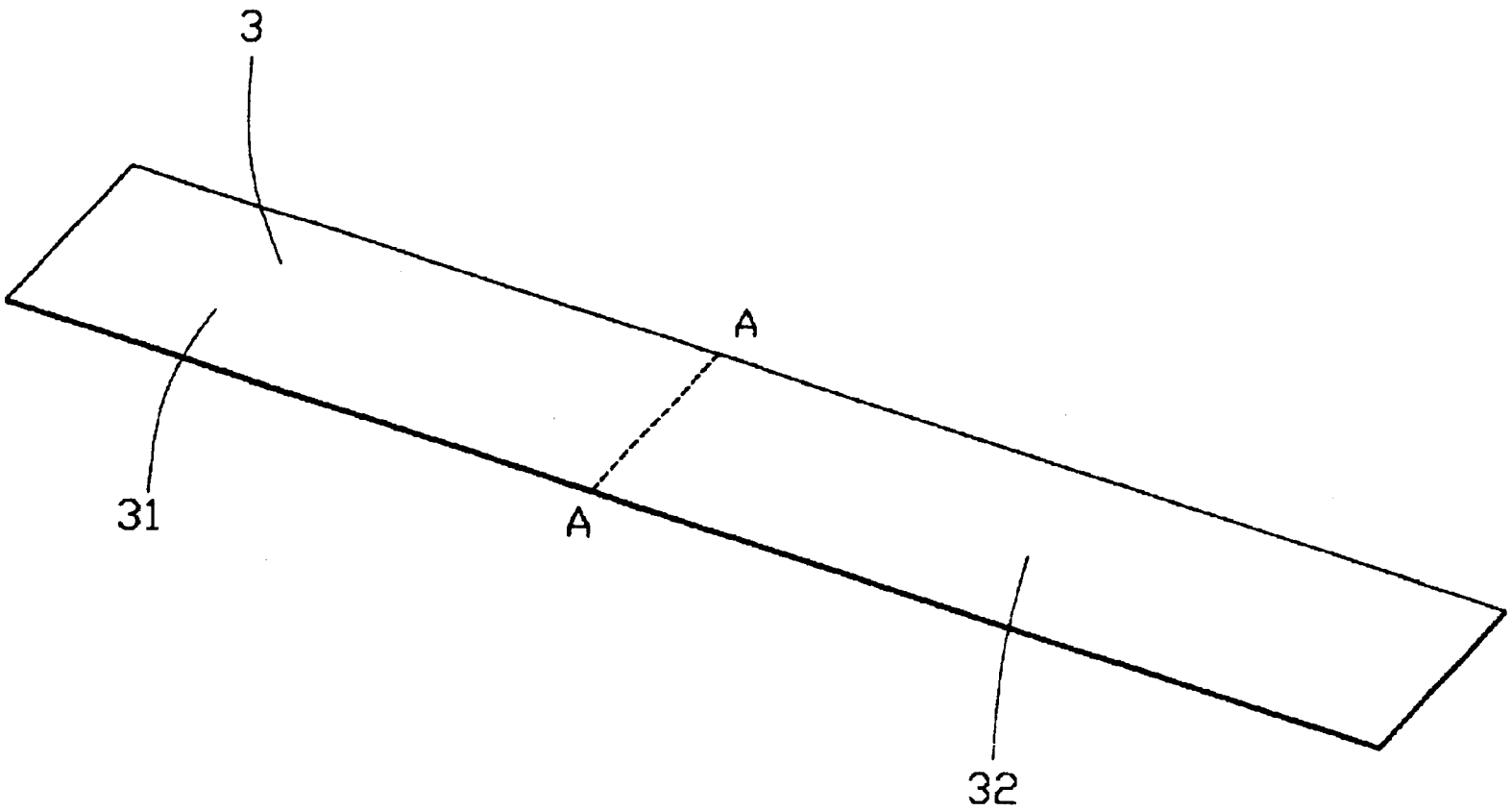
FIG. 5 is an expanded view of a conductive fabric tape of the grounding means.

Particularly referring to FIGS. 1 and 5, the conductive fabric tape 3 is integrally configured to substantially cover the inner and outer surfaces 201, 202 of the main portion 20 of the metallic shell 2. A first section 31 of the conductive fabric tape 3 starts from the forward end 23 of the metallic shell 2, spreads along and is finally entirely affixed on the inner surface 201 of the metallic shell 2. The conductive fabric tape 3 is then curved along a broken line A—A (FIG. 5), and rounded a rear end 25 of the metallic shell 2. A second section 32 of the conductive fabric tape 3 starts from the rear end 25 and extends parallel to the first section 31 along an opposite direction. The second section 32 of the conductive fabric tape 3 is affixed firmly on the outer surface 202 of the main portion 20 of the metallic shell 2 and extends beyond the forward end 23 of the metallic shell 2 a predetermined length L (FIG. 3).

Continue to FIG. 1, the lock member 4 of the grounding means 1 is adapted to retain the conductive fabric tape 3 in the metallic shell 2. The lock member 4 is received in the receiving space 24 of the metallic shell 2 and comprises a flat base portion 40 having a top face 401. A pair of ears 42 projects outwardly from opposite lateral edges of a front end 402 of the base portion 40 for correspondingly engaging with the cutouts 220 of the metallic shell 2. A pair of slots 44 is respectively defined in the base portion 40 adjacent to corresponding ears 42. The two slots 44 extends from the front end 402 and stops at about the middle of the base portion 40 to thereby increase the resilience of the pair of ears 42 which can facilitate the engagement between the ears 42 and the cutouts 220. The lock member 4 further has a number of embossments 46 protruded from the top face 401 of the base portion 40 for abutting against the first section 31 of the conductive fabric tape 3 adhered on the metallic shell 2. In a preferred embodiment, the lock member 4 is made from metallic material which has good conductivity.

Figure 6:
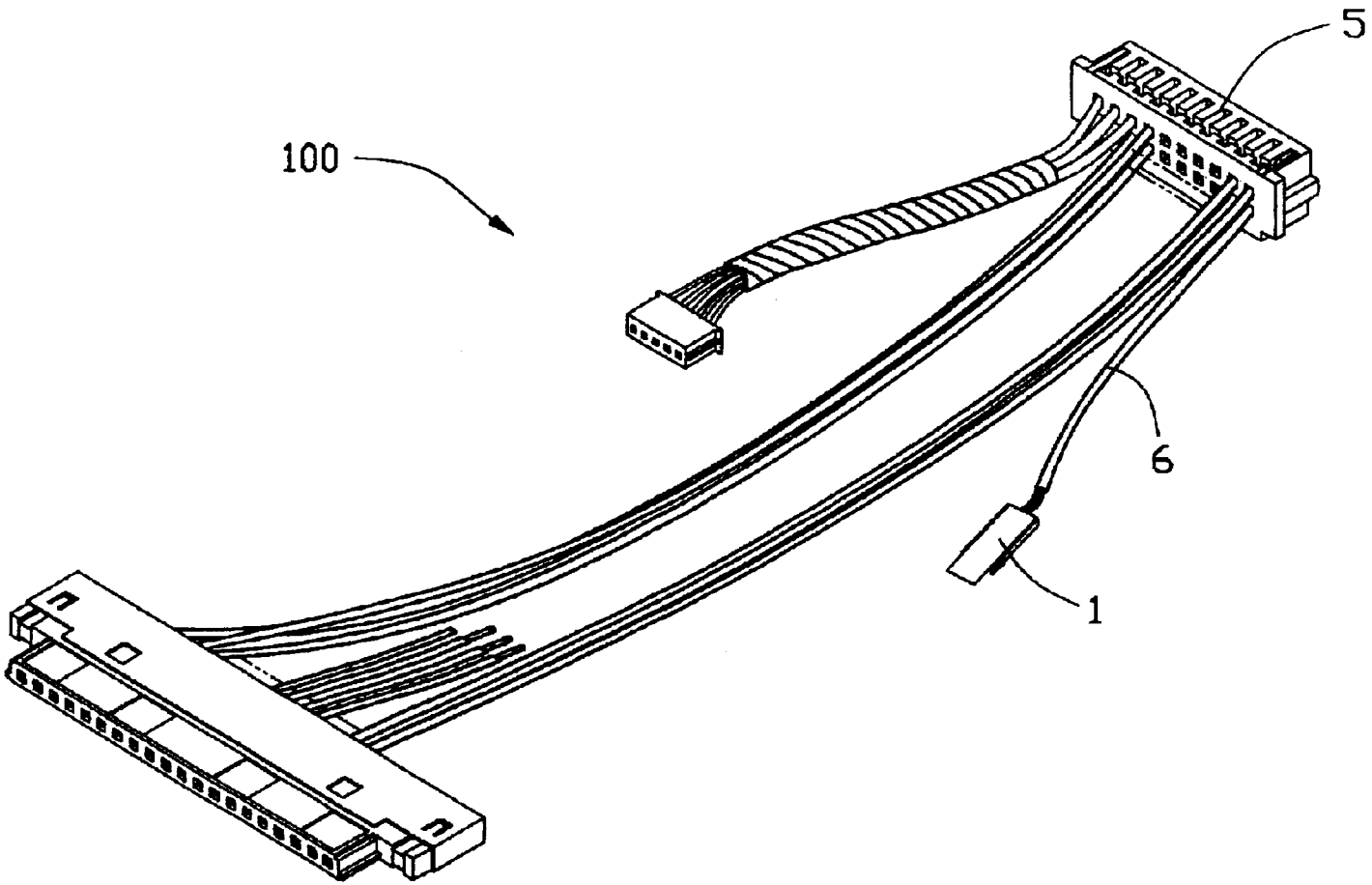
FIG. 6 is a perspective view of a cable assembly employing the grounding means.
Figure 7:
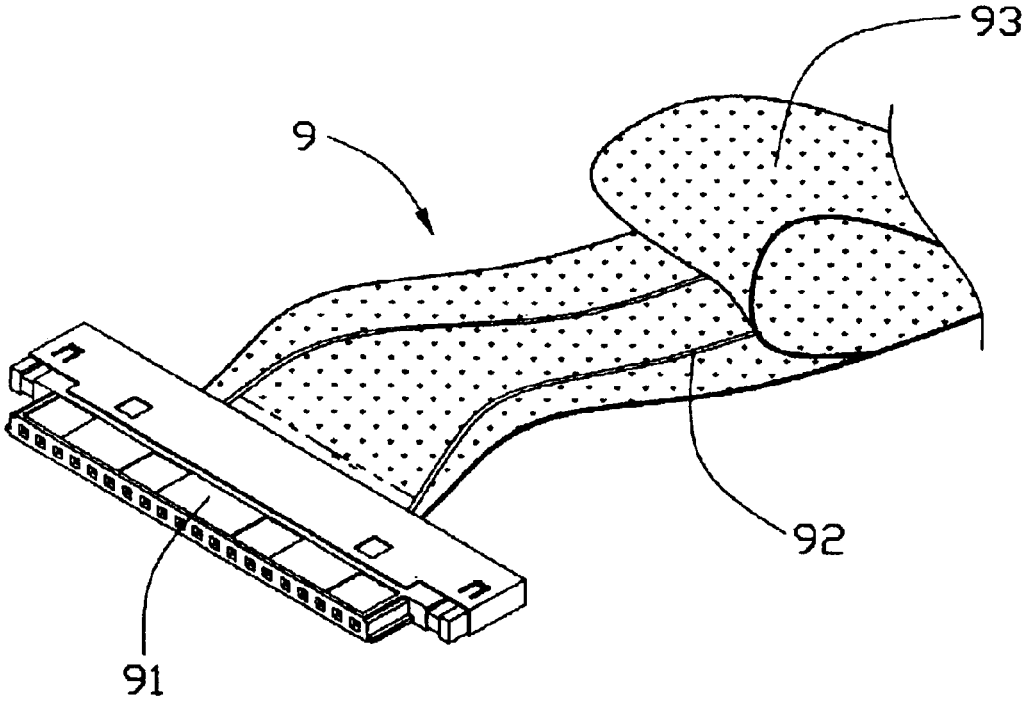
FIG. 7 (PRIOR ART)
FIG. 7 is a partially perspective view of a conventional cable assembly.
Figure 8:
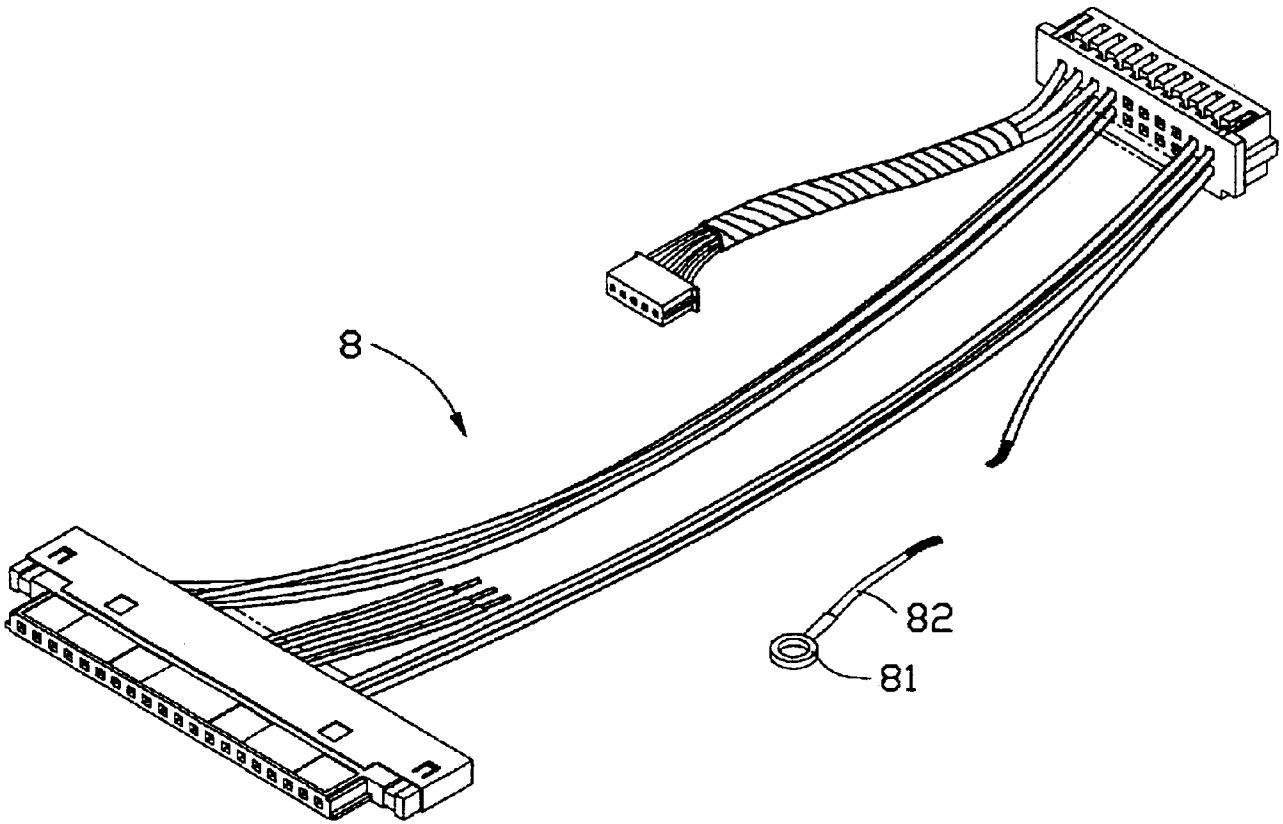
FIG. 8 (PRIOR ART)
FIG. 8 is a perspective view of a cable assembly employing a conventional grounding means.

In assembly, referring to FIG. 1 in conjunction with FIG. 6, the conductive fabric tape 3 firstly adheres to the inner surface 201 of the metallic shell 2 and then to the outer surface 202 with a predetermined length L extending beyond the forward end 23 of the metallic shell 2 for substantially conductively connecting with a grounding means included in the notebook computer. The lock member 4 is assembled to the metallic shell 2 and received in the receiving space 24 of the metallic shell 2 with the two ears 42 engaging with the cutouts 220 and the embossments 46 firmly abutting against the first section 31 of the conductive fabric tape 3. A ground line 6 extending from an electrical connector 5 of the cable assembly 100 is electrically sandwiched between the first section 31 of the fabric tape 3 and the lock member 4. Therefore, a reliably electrically contacting is not only established between the fabric tape 3 and the metallic shell 2, but also established between the fabric tape 3 and the lock member 4. The resistance is notably remained low for the conductive fabric tape 3 of the grounding means 1 has a large contacting area and thereby achieving more effective EMI. Further, because the conductive fabric tape 3 can be directly affixed onto the base plate of the notebook computer without using an additional screw, the whole height of the notebook computer in which the cable assembly 100 is used is decreased. Moreover, the assembly of the grounding means 1 is easy.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A grounding means for using in a cable assembly, comprising:

a metallic shell defining a receiving space therein and having an inner surface and an opposite outer surface;

a conductive fabric tape attached onto said inner and outer surfaces of said metallic shell; and a lock member received in said receiving space and securing said conductive fabric tape to said metallic shell.

2. The grounding means as described in claim 1, wherein a length of said conductive fabric tape extends beyond a forward edge of said metallic shell.

3. The grounding means as described in claim 2, wherein said metallic shell forms a pair of downwardly extending side walls from two lateral sides thereof, each side wall defining a cutout therewith.

4. The grounding means as described in claim 3, wherein said lock member comprises a pair of ears formed at a front end thereof, said pair of ears being respectively engaged with said cutouts of said metallic shell to thereby secure said lock member within said metallic shell.

5. The grounding means as described in claim 4, wherein said conductive fabric tape is partially sandwiched between said lock member and said metallic shell.

6. The grounding means as described in claim 5, wherein said lock member defines thereon a number of embossments mechanically abutting against said conductive fabric tape.

7. The grounding means as described in claim 1, wherein said lock member is made from conductive material.

8. A cable assembly adapted to interconnect a liquid crystal display (LCD) device and a base of a notebook computer, comprising:

an electrical connector;

a ground line electrically connecting with the electrical connector; and a grounding means electrically connecting with the ground line and comprising a metallic shell defining a receiving space therewith and having an inner surface and an opposite outer surface;

a conductive tape covering said inner and outer surfaces of said metallic shell, said conductive tape extending beyond a forward end of said metallic shell a predetermined length; and a lock member received in said receiving space of said metallic shell.

9. The cable assembly as described in claim 8, wherein said conductive tape is partially sandwiched between said metallic shell and said lock member.

10. The cable assembly as described in claim 9, wherein said lock member has a number of protrusions abutting against said conductive tape to thereby secure said conductive tape in position.

11. The cable assembly as described in claim 8, wherein said metallic shell has retaining means defined thereon and said lock member has locking means formed therewith engaging with said retaining means to thereby secure said lock member in said metallic shell.

12. The cable assembly as described in claim 8, wherein said ground line is sandwiched between a portion of the fabric tape covering said inner surface of the metallic shell and said lock member.

13. A cable connector assembly for use with a notebook computer, comprising:

an electrical connector;

at least one ground line extending from said connector;

a grounding means including:

a flexible conductive tape mechanically and electrically connected to a distal end of the ground line for being affixed onto a base of the notebook computer;

a rigid metallic shell secured to said conductive tape; and a rigid lock block received in the metallic shell for retaining said conductive tape onto said rigid metallic shell.

* * * * *